US011629031B2

(12) United States Patent
Zhang et al.

(10) Patent No.: US 11,629,031 B2
(45) Date of Patent: Apr. 18, 2023

(54) STRUCTURAL MEMBER OF GUIDED FASTENING CONNECTION FOR ELEVATOR GUIDE RAIL

(71) Applicant: CHANGSHU INSTITUTE OF TECHNOLOGY, Changshu (CN)

(72) Inventors: Fusheng Zhang, Changshu (CN); Yang Ge, Changshu (CN); Lingyun Ma, Changshu (CN); Bo Huang, Changshu (CN); Jianxin Ding, Changshu (CN); Yong Ren, Changshu (CN); Benlian Xu, Changshu (CN)

(73) Assignee: CHANGSHU INSTITUTE OF TECHNOLOGY, Changshu (CN)

( * ) Notice: Subject to any disclaimer, the term of this patent is extended or adjusted under 35 U.S.C. 154(b) by 0 days.

(21) Appl. No.: 17/838,178

(22) Filed: Jun. 11, 2022

(65) Prior Publication Data

US 2022/0402727 A1 Dec. 22, 2022

(30) Foreign Application Priority Data

Jun. 22, 2021 (CN) ..... 202110689099.0

(51) Int. Cl.
*B66B 7/02* (2006.01)

(52) U.S. Cl.
CPC ..... *B66B 7/024* (2013.01)

(58) Field of Classification Search
CPC ..... B66B 7/024; B66B 7/027; B66B 7/022; B66B 7/023; E04H 12/20; E04G 17/14; E04G 17/16
See application file for complete search history.

(56) References Cited

U.S. PATENT DOCUMENTS

| | | | | |
|---|---|---|---|---|
| 10,094,509 | B2 * | 10/2018 | So | E04G 3/34 |
| 2011/0262215 | A1 * | 10/2011 | Thacker | E04G 7/307 403/81 |
| 2012/0263554 | A1 * | 10/2012 | Sanz Gamboa | B66B 7/026 411/81 |

FOREIGN PATENT DOCUMENTS

| | | | | |
|---|---|---|---|---|
| CN | 112110314 | A * | 12/2020 | |
| CN | 112693991 | A * | 4/2021 | B66B 7/022 |
| CN | 113277401 | A * | 8/2021 | B66B 7/022 |
| CN | 113353761 | A * | 9/2021 | |
| EP | 1743863 | A1 * | 1/2007 | B66B 7/02 |
| ES | 2881548 | A1 * | 11/2021 | |
| JP | 2006290488 | A * | 10/2006 | B66B 7/026 |

(Continued)

*Primary Examiner* — Diem M Tran
(74) *Attorney, Agent, or Firm* — Bayramoglu Law Offices LLC

(57) ABSTRACT

A structural member of guided fastening connection for an elevator guide rail includes a vertical docking plate, wherein a fixing side plate is welded on two sides of the vertical docking plate symmetrically, a fixing hole is provided on a side of the fixing side plates, an upright plugging plate is welded at two ends of the vertical docking plate symmetrically, the upright plugging plates are docked with a first buckling block on a side, the upright plugging plates are docked with a second buckling block on a side away from the first buckling blocks, the fixing side plates are welded with a lateral arc-shaped plate horizontally on a side away from the vertical docking plate, a turnover strut is provided between the lateral arc-shaped plates horizontally, a middle fixing rod is plugged within a top face of the lateral arc-shaped plates.

9 Claims, 7 Drawing Sheets

(56) References Cited

FOREIGN PATENT DOCUMENTS

| | | | | |
|---|---|---|---|---|
| WO | WO-2016118722 | A1 * | 7/2016 | ..... B66B 11/0407 |
| WO | WO-2018234243 | A1 * | 12/2018 | ..... B66B 7/026 |

* cited by examiner

STRUCTURAL MEMBER OF GUIDED FASTENING CONNECTION FOR ELEVATOR GUIDE RAIL

CROSS REFERENCE TO THE RELATED APPLICATIONS

This application is based upon and claims priority to Chinese Patent Application No. 202110689099.0, filed on Jun. 22, 2021, the entire contents of which are incorporated herein by reference.

TECHNICAL FIELD

The present invention relates to the technical field of elevator guide rails, and in particular, to a structural member of guided fastening connection for an elevator guide rail.

BACKGROUND

An elevator guide rail is an elevator component composed of a steel rail and a connecting plate, which is divided into a car guide rail and a counter-weight guide rail. From the shape of a section, it is divided into three forms, namely, a T shape, an L shape, and a hollow shape. The guide rails bear a car, an impact force during braking of an elevator, an impact force during braking of a security clamp, etc., while playing a guiding role. The magnitude of these forces is correlated with the payload mass and speed of the elevator, the guide rails should be selected according to the speed and payload mass of the elevator. The car guide rail is often referred to as a main rail, and the counter-weight guide rail as an auxiliary rail.

For the existing elevator guide rail, during docking, a socketing structure is employed for connection, so that cracks or unevenness may occur at a connection position, the elevator may get stuck during slide running, and an unstable case may occur during the running of the elevator, so as to enable persons inside to feel dangers, which is not conducive to the use of the existing elevator guide rail, and meanwhile, fixing only by socketing makes the fixing unstable, so that a danger of derailment may occur when the elevator runs at a high speed.

SUMMARY

The object of the present invention is to provide a structural member of guided fastening connection for an elevator guide rail, in order to solve the following problems mentioned above in the background art: for the existing elevator guide rail, during docking, a socketing structure is employed for connection, so that cracks or unevenness may occur at a connection position, the elevator may get stuck during slide running, and an unstable case may occur during the running of the elevator, so as to enable persons inside to feel dangers, which is not conducive to the use of the existing elevator guide rail, and meanwhile, fixing only by socketing makes the fixing unstable, so that a danger of derailment may occur when the elevator runs at a high speed.

To achieve the above object, the present invention provides the following technical solution:

A structural member of guided fastening connection for an elevator guide rail includes a vertical docking plate, wherein a fixing side plate is welded on two sides of the vertical docking plate symmetrically, a fixing hole is provided on a side of the fixing side plates, an upright plugging plate is welded at two ends of the vertical docking plate symmetrically, the upright plugging plates are docked with a first buckling block on a side, the upright plugging plates are docked with a second buckling block on a side away from the first buckling blocks, the fixing side plates are welded with a lateral arc-shaped plate horizontally on a side away from the vertical docking plate, a turnover strut is provided between the lateral arc-shaped plates horizontally, a middle fixing rod is plugged within a top face of the lateral arc-shaped plates, the top faces of the lateral arc-shaped plates are provided with a limiting hole uniformly, an adjusting nut block is snapped on a side of the turnover struts, the turnover struts are plugged with an extension rod on a side away from the lateral arc-shaped plates, the extension rods are provided with an open slot on a side away from the turnover struts, a turnover insertion rod is plugged on an inner side of the open slots, the turnover insertion rods are welded with a fixing plate at an end away from the open slots, a connecting hole is provided on a side of the fixing plates uniformly, a main rail rod is docked at the two ends of the vertical docking plate, a lateral fixing plate is welded on two sides of the main rail rod, a connecting through-hole is provided on a side of the lateral fixing plates uniformly, a hidden groove is provided at an end of the main rail rod symmetrically, a lateral horizontal rod is welded on a side of the vertical docking plate horizontally, the extension rods are plugged with a plugging rod at an end away from the turnover struts, an upright limiting rod is plugged on an end of the turnover struts, an insertion hole is provided on a side of the upright plugging plates uniformly, a socketing pipe is plugged on an inner side of the insertion holes horizontally, a plugging snap rod is plugged on the inner sides of the insertion holes horizontally, the main rail rod is provided with a mating insertion slot at an end close to the vertical docking plate, an extension slot hole is provided on an inner side of the mating insertion slots, the turnover struts are provided with an inner socketing slot at an end away from the lateral arc-shaped plates, a transverse limiting slot is provided on an inner side of the inner socketing slots, a bottom socketing slot is provided on a bottom face of the inner sides of the inner socketing slots horizontally, a turnover snap plate is snapped on an inner side of the bottom socketing slots, a plugging turnover rod is plugged on a side of the turnover snap plates, a reset spring is socketed on an outer side of two ends of the plugging turnover rods fixedly, a lateral snapping block is welded on two sides of the extension rods symmetrically, a bottom sleeve slot is provided on a bottom face of the extension rods horizontally, a rack rod is welded on an inner side of the bottom sleeve slots horizontally, a first extension rod is welded at an end of the plugging turnover rods horizontally, and a limiting ring is welded on an outer side of the extension rods fixedly.

As a preferred implementation of the present invention: the number of the fixing side plates is two, the two fixing side plates are respectively provided at a position close to a side of the vertical docking plate symmetrically and fixedly, a side of the fixing side plates remains at the same horizontal position as a side of the vertical docking plate, the fixing holes are provided at a position close to a corner of a side of the fixing side plates respectively, the number of the upright plugging plates is two, and the two upright plugging plates are respectively provided at a position on a vertical central line of the vertical docking plate symmetrically and fixedly.

As a preferred implementation of the present invention: the first buckling blocks and the second buckling blocks are provided consistently in size and respectively snapped at a position on an inner side of the hidden grooves correspondingly, the number of the lateral arc-shaped plates is four, the four lateral arc-shaped plates are superposed on a side of the fixing side plates close to a central position two by two in parallel, and a side of the four lateral arc-shaped plates is welded at a position on two ends of the lateral horizontal rod vertically and fixedly.

As a preferred implementation of the present invention: the number of the turnover struts is two, an end of the two turnover struts is plugged at a position between the same group of lateral arc-shaped plates horizontally, the middle fixing rod is plugged through a position at an end of the turnover struts vertically, there are a plurality of limiting holes, the plurality of limiting holes are arranged at a position on the top faces of the lateral arc-shaped plates close to an arc-shaped side at equal intervals in the shape of an arc, and the adjusting nut blocks have one end provided with a hexagonal hole and the other end welded at a position on an end of the first extension rods horizontally.

As a preferred implementation of the present invention: an end of the extension rods is plugged at a position on the inner sides of the inner socketing slots horizontally, the turnover insertion rods have an end extending through the open slots to an outer side and an extension end welded onto a central position of a side of the fixing plates vertically, the connecting holes are provided at a position on a side of the fixing plates close to four corners, the lateral fixing plates are provided in consistent with the fixing side plates, and an end of the lateral fixing plates is docked at a position at two ends of the fixing side plates.

As a preferred implementation of the present invention: the hidden grooves are respectively provided at a position at two ends of the extension slot holes symmetrically, the interior of the hidden grooves remains communicated with the interior of the extension slot holes, the lateral horizontal rod is fixedly provided at a central position of a side of the vertical docking plate horizontally, two ends of the lateral horizontal rod are welded at a position on a side of the lateral arc-shaped plates horizontally, a bottom end of the plugging rods extends through a top face of the extension rods to the inner sides of the open slots, and a plugging end of the plugging rods passes through and is plugged at a position on an inner side of an end of the turnover insertion rods.

As a preferred implementation of the present invention: two ends of the upright limiting rods are both plugged at a position on an inner side of a corresponding one of the limiting holes symmetrically and fixedly, an end of the socketing pipes is welded at a position at an end of the second buckling blocks horizontally, one end of the plugging snap rods is welded at a position at an end of the first buckling blocks horizontally, the other end of the plugging snap rods is plugged on an inner side of the socketing pipes, a snap ring is provided on an outer side of the plugging snapping rods, a snap slot is provided on the inner sides of the socketing pipes uniformly, the mating insertion slots are respectively socketed at a position on an outer side of the upright plugging plates symmetrically, and the extension slot holes are respectively communicated with two ends of the insertion holes correspondingly.

As a preferred implementation of the present invention: the bottom socketing slots are provided at a position close to an open end of the inner socketing slots horizontally, the interior of the bottom socketing slots remains communicated with the interior of the inner socketing slots, a side of the turnover snap plates is plugged at a position between bottom racks of the rack rods in an inclined manner, two ends of the plugging turnover rods are plugged at a position on an inner side of the bottom socketing slots, and the lateral snapping blocks are respectively snapped at a position on an inner side of the transverse limiting slots correspondingly.

As a preferred implementation of the present invention: the bottom sleeve slots are provided at a position on a central line of the bottom faces of the extension rods horizontally, the first extension rods are provided at a position at an end of the plugging turnover rods close to the adjusting nut blocks horizontally and fixedly, and an end of the first extension rods is welded at a central position of an end of the adjusting nut blocks horizontally.

Compared with the prior art, the present invention features the following advantageous effects:

1. In the present invention, connection positions are made more seamless with a socketing design, so that the elevator will get stuck during sliding; after hammering central positions of the first buckling blocks and the second buckling blocks, the plugging snap rods are plugged in the interior of the socketing pipes fixedly, and the first buckling blocks and the second buckling blocks are snapped into the interior of the hidden grooves at the same time, so that a connection position between the main rail rod and the vertical docking plate remains in a smooth state; then, a bolt is plugged into the interior of the fixing holes and the connecting through-holes, so that the fixing side plates and the lateral fixing plates are fixed at specified positions on a side wall of an elevator shaft; after playing a turnover role for positions of the turnover struts between the lateral arc-shaped plates, the turnover struts turn over to a specified angle; by plugging the plugging rods into the interior of the limiting holes to make them fixed and then playing an extension and stretching role for the extension rods towards two sides, the fixing plates at an end of the extension rods are docked with and abut against a position on the side walls of the elevator shaft wall; under the supporting of the reset springs, the turnover snap plates turn over to the interior of the bottom sleeve slots, and the turnover snap plates are plugged at a position between the rack rods in an inclined manner and snapped therein, while the lateral snapping blocks are enabled to slide in the interior of the transverse limiting slots more stably.

2. In the present invention, the bolts are plugged in the interior of the connecting holes, so that the fixing plates are fixed at specified positions, which makes the vertical docking plate more stable; if there is a need to remove the vertical docking plate, the adjusting nut blocks are rotated, so that the extension rods have a function of driving the plugging turnover rods to turn over, thereby driving the turnover snap plates to be received into the interior of the bottom socketing slots; therefore, the extension rods may contract into the interior of the inner socketing slots; and then, removing may be performed successively. The device according to the present invention is designed to be an integrated structure, which is simple and convenient to operate. Snapping is employed during hiding to make a smoother surface without affecting the sliding smoothness of the elevator. Meanwhile, an adjustable structure is employed to make it suitable for installation and operation in a variety of environments.

BRIEF DESCRIPTION OF THE DRAWINGS

Other features, objects, and advantages of the present invention will become apparent upon reading the detailed description of non-limiting embodiments made with reference to the accompanying drawings below.

In the figures: 1. vertical docking plate; 2. fixing side plate; 3. fixing hole; 4. upright plugging plate; 5. first buckling block; 6. second buckling block; 7. lateral arc-shaped plate; 8. turnover strut; 9. middle fixing rod; 10. limiting hole; 11. adjusting nut block; 12. extension rod; 13. open slot; 14. turnover insertion rod; 15. fixing plate; 16. connecting hole; 17. main rail rod; 18. lateral fixing plate; 19. connecting through-hole; 20. hidden groove; 21. lateral horizontal rod; 22. plugging rod; 23. upright limiting rod; 24. insertion hole; 25. socketing pipe; 26. plugging snap rod; 27. mating insertion slot; 28. extension slot hole; 29. inner socketing slot; 30. transverse limiting slot; 31. bottom socketing slot; 32. turnover snap plate; 33. plugging turnover rod; 34. reset spring; 35. lateral snapping block; 36. bottom sleeve slot; 37. rack rod; 38. first extension rod; and 39. limiting ring.

DETAILED DESCRIPTION OF THE EMBODIMENTS

Figure 1:
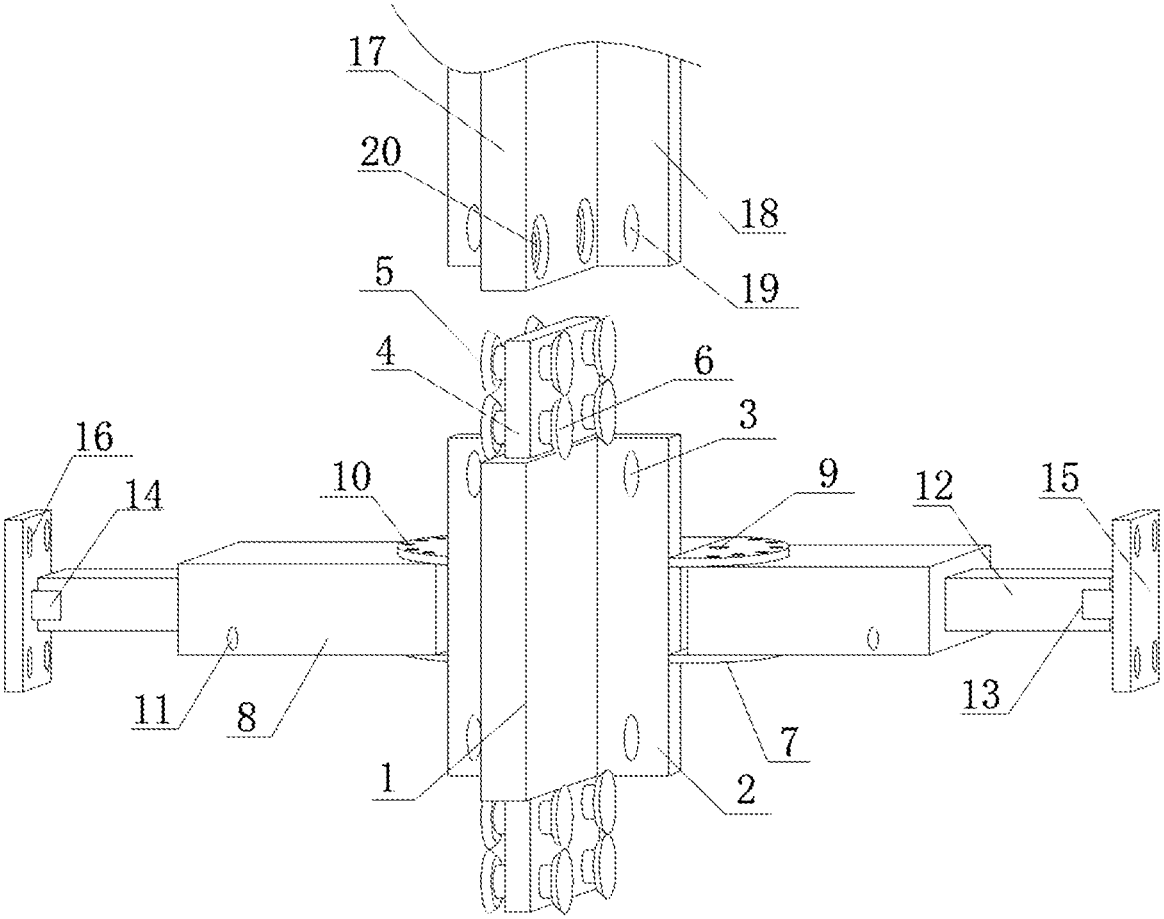
FIG. 1 is a schematic isometric structural diagram of a structural member of guided fastening connection for an elevator guide rail.
Figure 2:
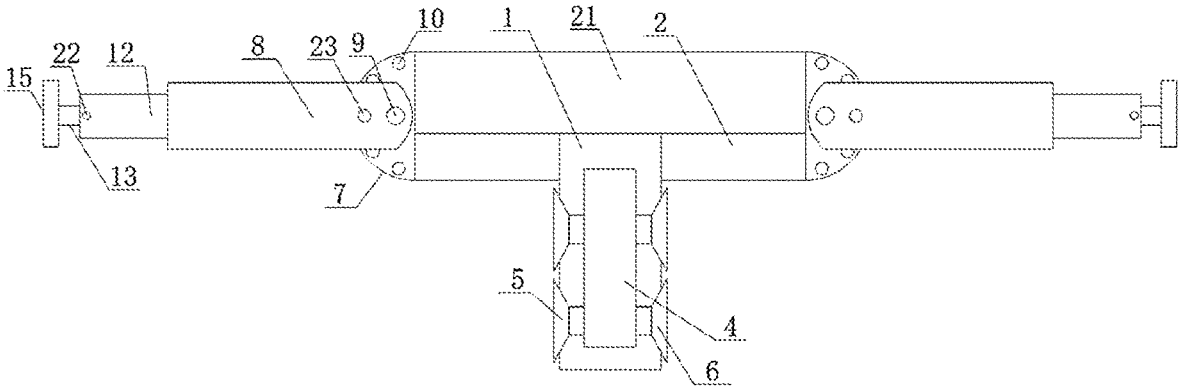
FIG. 2 is a schematic structural diagram showing top connection details of a structural member of guided fastening connection for an elevator guide rail.

Referring to FIGS. 1-2, in the embodiments of the present invention, a structural member of guided fastening connection for an elevator guide rail includes a vertical docking plate 1. A fixing side plate 2 is welded on two sides of the vertical docking plate 1 symmetrically, a fixing hole 3 is provided on a side of the fixing side plates 2, and an upright plugging plate 4 is welded at two ends of the vertical docking plate 1 symmetrically. The number of the fixing side plates 2 is two, the two fixing side plates 2 are respectively provided at a position close to a side of the vertical docking plate 1 symmetrically and fixedly, a side of the fixing side plates 2 remains at the same horizontal position as a side of the vertical docking plate 1, the fixing holes 3 are provided at a position close to a corner of a side of the fixing side plates 2 respectively, the number of the upright plugging plates 4 is two, and the two upright plugging plates 4 are respectively provided at a position on a vertical central line of the vertical docking plate 1 symmetrically and fixedly. The upright plugging plates 4 are docked with a first buckling block 5 on a side, the upright plugging plates 4 are docked with a second buckling block 6 on a side away from the first buckling blocks 5, and the fixing side plates 2 are welded with a lateral arc-shaped plate 7 horizontally on a side away from the vertical docking plate 1. The first buckling blocks 5 and the second buckling blocks 6 are provided consistently in size and respectively snapped at a position on an inner side of the hidden grooves 20 correspondingly, the number of the lateral arc-shaped plates 7 is four, the four lateral arc-shaped plates 7 are superposed on a side of the fixing side plates 2 close to a central position two by two in parallel, and a side of the four lateral arc-shaped plates 7 is welded at a position on two ends of the lateral horizontal rod 21 vertically and fixedly. A turnover strut 8 is provided between the lateral arc-shaped plates 7 horizontally, a middle fixing rod 9 is plugged within a top face of the lateral arc-shaped plates 7, the top faces of the lateral arc-shaped plates 7 are provided with a limiting hole 10 uniformly, and an adjusting nut block 11 is snapped on a side of the turnover struts 8. The number of the turnover struts 8 is two, an end of the two turnover struts 8 is plugged at a position between the same group of lateral arc-shaped plates 7 horizontally, the middle fixing rod 9 is plugged through a position at an end of the turnover struts 8 vertically, there are a plurality of limiting holes 10, the plurality of limiting holes 10 are arranged at a position on the top faces of the lateral arc-shaped plates 7 close to an arc-shaped side at equal intervals in the shape of an arc, and the adjusting nut blocks 11 have one end provided with a hexagonal hole and the other end welded at a position on an end of the first extension rods 38 horizontally. The turnover struts 8 are plugged with an extension rod 12 on a side away from the lateral arc-shaped plates 7, the extension rods 12 are provided with an open slot 13 on a side away from the turnover struts 8, a turnover insertion rod 14 is plugged on an inner side of the open slots 13, the turnover insertion rods 14 are welded with a fixing plate 15 at an end away from the open slots 13, a connecting hole 16 is provided on a side of the fixing plates 15 uniformly, a main rail rod 17 is docked at the two ends of the vertical docking plate 1, and a lateral fixing plate 18 is welded on two sides of the main rail rod 17. An end of the extension rods 12 is plugged at a position on the inner sides of the inner socketing slots 29 horizontally, the turnover insertion rods 14 have an end extending through the open slots 13 to an outer side and an extension end welded onto a central position of a side of the fixing plates 15 vertically, the connecting holes 16 are provided at a position on a side of the fixing plates 15 close to four corners, the lateral fixing plates 18 are provided in consistent with the fixing side plates 2, and an end of the lateral fixing plates 18 is docked at a position at two ends of the fixing side plates 2. A connecting through-hole 19 is provided on a side of the lateral fixing plates 18 uniformly, a hidden groove 20 is provided at an end of the main rail rod 17 symmetrically, a lateral horizontal rod 21 is welded on a side of the vertical docking plate 1 horizontally, and the extension rods 12 are plugged with a plugging rod 22 at an end away from the turnover struts 8. the hidden grooves 20 are respectively provided at a position at two ends of the extension slot holes 28 symmetrically, the interior of the hidden grooves 20 remains communicated with the interior of the extension slot holes 28, the lateral horizontal rod 21 is fixedly provided at a central position of a side of the vertical docking plate 1 horizontally, two ends of the lateral horizontal rod 21 are welded at a position on a side of the lateral arc-shaped plates 7 horizontally, a bottom end of the plugging rods 22 extends through a top face of the extension rods 12 to the inner sides of the open slots 13, and a plugging end of the plugging rods 22 passes through and is plugged at a position on an inner side of an end of the turnover insertion rods 14. An upright limiting rod 23 is plugged on an end of the turnover struts 8. Two ends of the upright limiting rods 23 are both plugged at a position on an inner side of a corresponding one of the limiting holes 10 symmetrically and fixedly.

Figure 3:
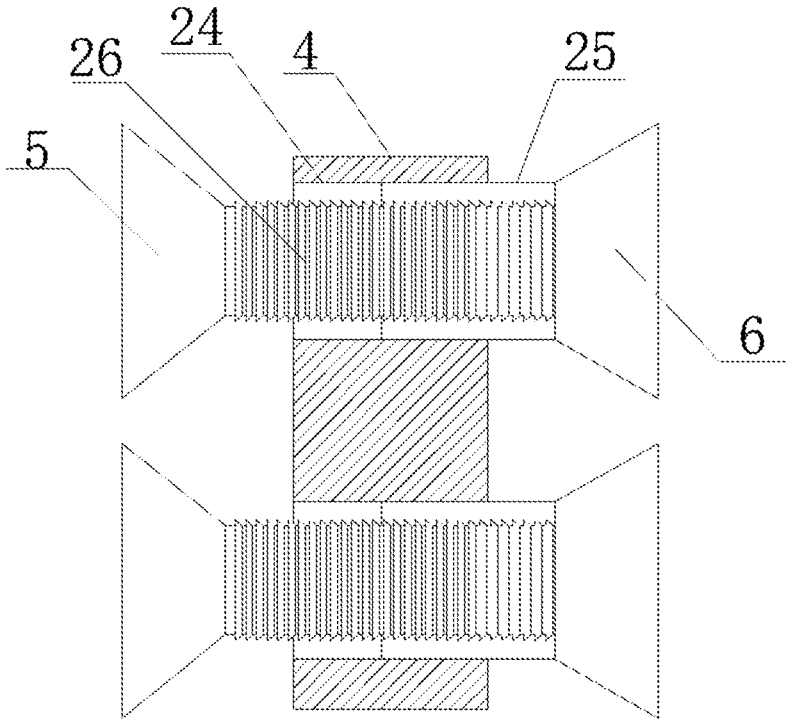
FIG. 3 is a schematic structural diagram showing front sectional connection details of an upright plugging plate in a structural member of guided fastening connection for an elevator guide rail.
Figure 4:
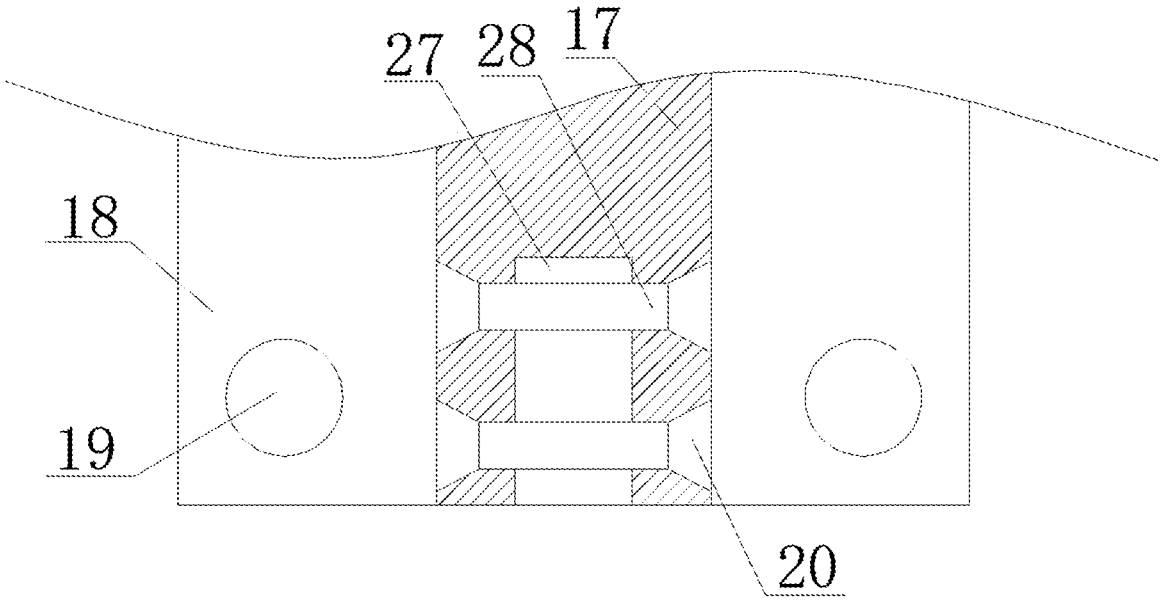
FIG. 4 is a schematic structural diagram showing front sectional connection details of a main rail rod in a structural member of guided fastening connection for an elevator guide rail.

Referring to FIGS. 3-4, in the embodiments of the present invention, in the structural member of guided fastening connection for an elevator guide rail, an insertion hole 24 is provided on a side of the upright plugging plates 4 uniformly, a socketing pipe 25 is plugged on an inner side of the insertion holes 24 horizontally, a plugging snap rod 26 is plugged on the inner sides of the insertion holes 24 horizontally, the main rail rod 17 is provided with a mating insertion slot 27 at an end close to the vertical docking plate 1, and an extension slot hole 28 is provided on an inner side of the mating insertion slots 27. An end of the socketing pipes 25 is welded at a position at an end of the second buckling blocks 6 horizontally, one end of the plugging snap rods 26 is welded at a position at an end of the first buckling blocks 5 horizontally, the other end of the plugging snap rods 26 is plugged on an inner side of the socketing pipes 25, a snap ring is provided on an outer side of the plugging snapping rods 26, a snap slot is provided on the inner sides of the socketing pipes 25 uniformly, the mating insertion slots 27 are respectively socketed at a position on an outer side of the upright plugging plates 4 symmetrically, and the extension slot holes 28 are respectively communicated with two ends of the insertion holes 24 correspondingly.

Figure 5:
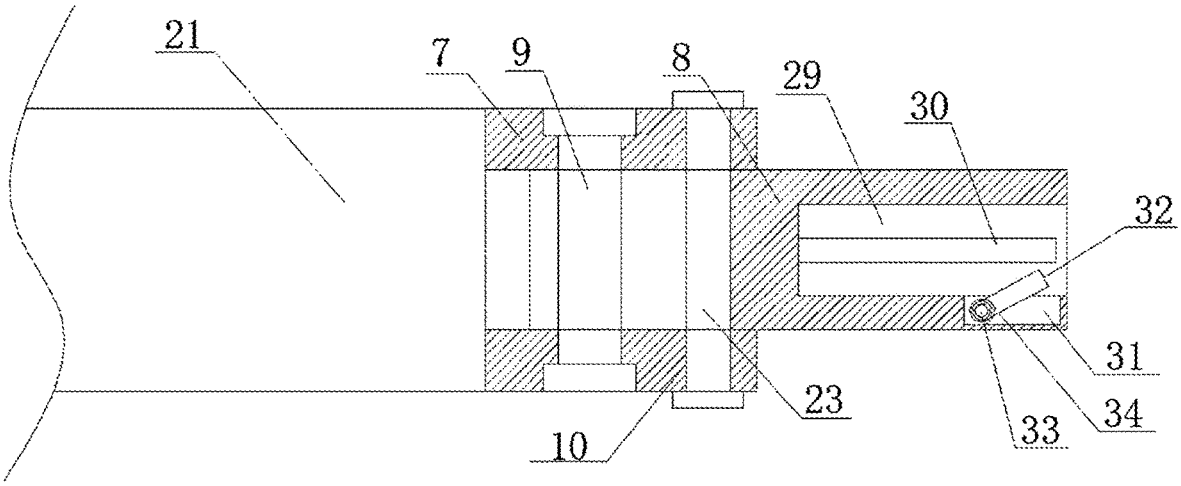
FIG. 5 is a schematic structural diagram showing top connection details of a turnover strut in a structural member of guided fastening connection for an elevator guide rail.
Figure 6:
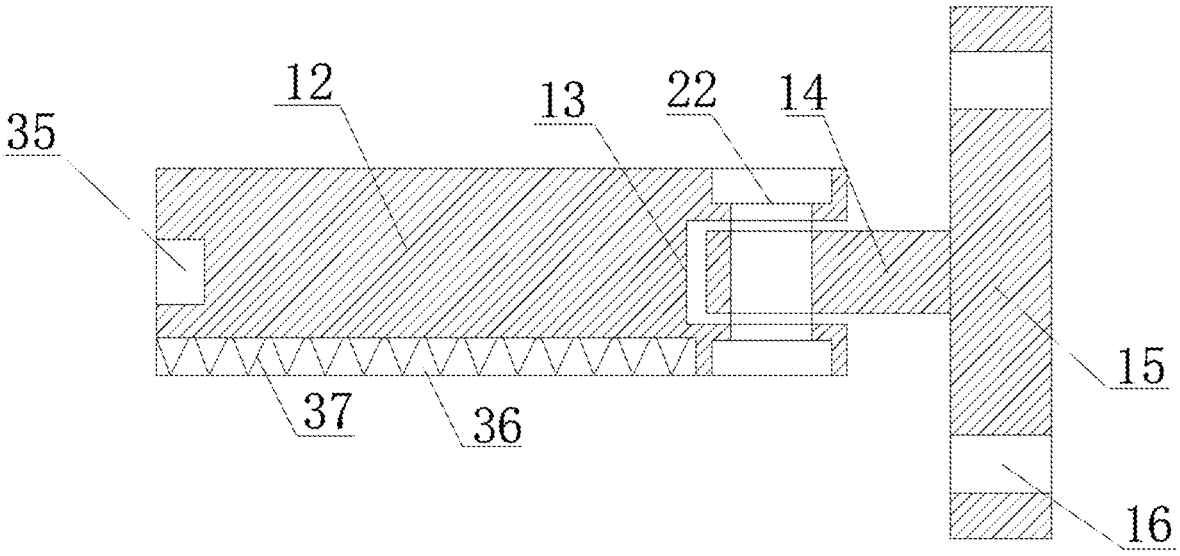
FIG. 6 is a schematic structural diagram showing front sectional connection details of an extension rod in a structural member of guided fastening connection for an elevator guide rail.
Figure 7:
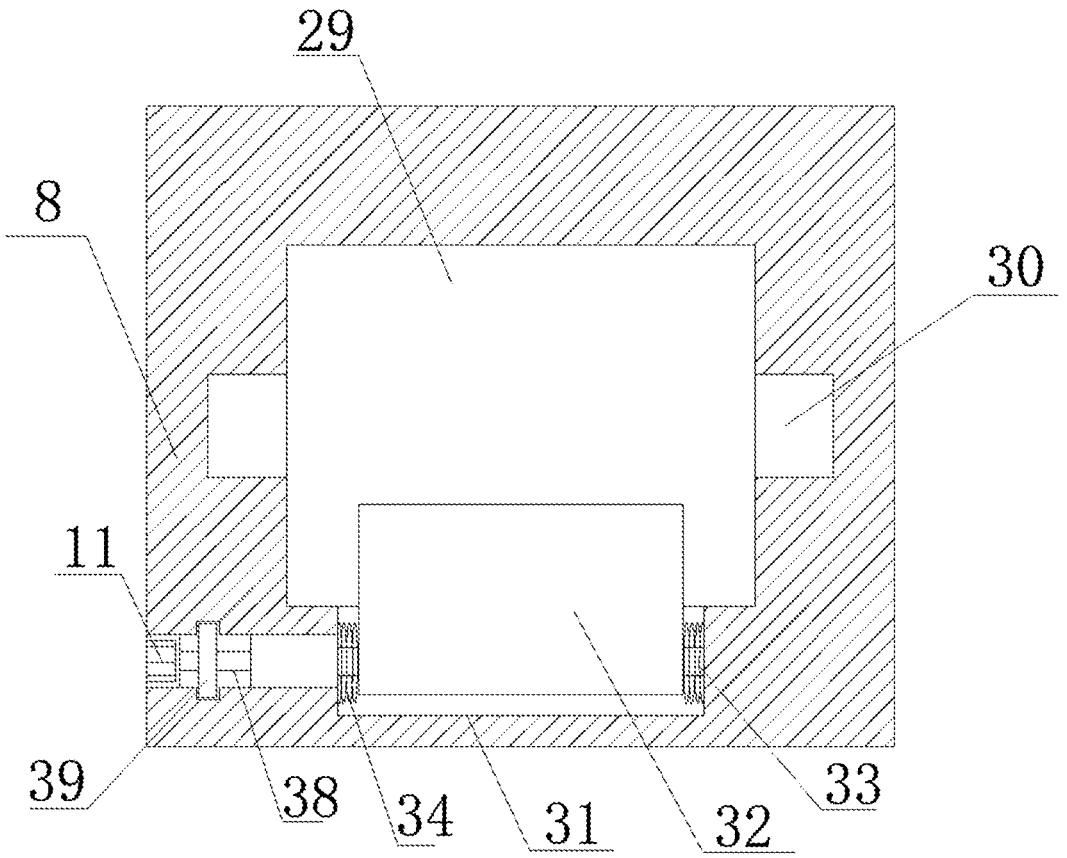
FIG. 7 is a schematic structural diagram showing side sectional connection details of a turnover strut in a structural member of guided fastening connection for an elevator guide rail.

Referring to FIGS. 5-7, in the embodiments of the present invention, in the structural member of guided fastening connection for an elevator guide rail, the turnover struts 8 are provided with an inner socketing slot 29 at an end away from the lateral arc-shaped plates 7, a transverse limiting slot 30 is provided on an inner side of the inner socketing slots 29, a bottom socketing slot 31 is provided on a bottom face of the inner sides of the inner socketing slots 29 horizontally, a turnover snap plate 32 is snapped on an inner side of the bottom socketing slots 31, a plugging turnover rod 33 is plugged on a side of the turnover snap plates 32, a reset spring 34 is socketed on an outer side of two ends of the plugging turnover rods 33 fixedly, and a lateral snapping block 35 is welded on two sides of the extension rods 12 symmetrically. The bottom socketing slots 31 are provided at a position close to an open end of the inner socketing slots 29 horizontally, the interior of the bottom socketing slots 31 remains communicated with the interior of the inner socketing slots 29, a side of the turnover snap plates 32 is plugged at a position between bottom racks of the rack rods 37 in an inclined manner, two ends of the plugging turnover rods 33 are plugged at a position on an inner side of the bottom socketing slots 31, and the lateral snapping blocks 35 are respectively snapped at a position on an inner side of the transverse limiting slots 30 correspondingly. A bottom sleeve slot 36 is provided on a bottom face of the extension rods 12 horizontally, a rack rod 37 is welded on an inner side of the bottom sleeve slots 36 horizontally, and a first extension rod 38 is welded at an end of the plugging turnover rods 33 horizontally. The bottom sleeve slots 36 are provided at a position on a central line of the bottom faces of the extension rods 12 horizontally, the first extension rods 38 are provided at a position at an end of the plugging turnover rods 33 close to the adjusting nut blocks 11 horizontally and fixedly, and an end of the first extension rods 38 is welded at a central position of an end of the adjusting nut blocks 11 horizontally. A limiting ring 39 is welded on an outer side of the extension rods 38 fixedly.

The components are all general standards or those known by a person skilled in the art, and for a person skilled in the art, structures and principles thereof may all be known through technical manuals or derived by conventional experimental methods.

The working principle of the present invention is as follows:

an end of the main rail rod 17 is docked at a position at the two ends of the vertical docking plate 1, and the mating insertion slots 27 are socketed at a position on an outer side of the upright plugging plates 4 correspondingly; the plugging snap rods 26 and the socketing pipes 25 are driven by the first buckling blocks 5 and the second buckling blocks 6 to plug into the interior of the insertion holes 24; after hammering central positions of the first buckling blocks 5 and the second buckling blocks 6, the plugging snap rods 26 are plugged in the interior of the socketing pipes 25 fixedly, and the first buckling blocks 5 and the second buckling blocks 6 are snapped into the interior of the hidden grooves 20 at the same time, so that a connection position between the main rail rod 17 and the vertical docking plate 1 remains in a smooth state; then, a bolt is plugged into the interior of the fixing holes 3 and the connecting through-holes 19, so that the fixing side plates 2 and the lateral fixing plates 18 are fixed at specified positions on a side wall of an elevator shaft; after playing a turnover role for positions of the turnover struts 8 between the lateral arc-shaped plates 7, the turnover struts 8 turn over to a specified angle; by plugging the plugging rods 22 into the interior of the limiting holes 10 to make them fixed and then playing an extension and stretching role for the extension rods 12 towards two sides, the fixing plates 15 at an end of the extension rods 12 are docked with and abut against a position on the side walls of the elevator shaft wall; under the supporting of the reset springs 34, the turnover snap plates 32 turn over to the interior of the bottom sleeve slots 36, and the turnover snap plates 32 are plugged at a position between the rack rods 37 in an inclined manner and snapped therein, while the lateral snapping blocks 35 are enabled to slide in the interior of the transverse limiting slots 30 more stably. The bolts are plugged in the interior of the connecting holes 16, so that the fixing plates 15 are fixed at specified positions, which makes the vertical docking plate 1 more stable; if there is a need to remove the vertical docking plate 1, the adjusting nut blocks 11 are rotated, so that the extension rods 38 have a function of driving the plugging turnover rods 33 to turn over, thereby driving the turnover snap plates 32 to be received into the interior of the bottom socketing slots 31; therefore, the extension rods 12 may contract into the interior of the inner socketing slots 29; and then, removing may be performed successively.

The foregoing descriptions are merely preferred specific implementations of the present invention, and are not intended to limit the protection scope of the present invention. Any equivalent replacements or changes made by a person skilled in the art according to the technical solution of the present invention and the inventive concepts thereof within the technical scope disclosed in the present invention shall fall within the protection scope of the present invention.

What is claimed is:

1. A structural member of guided fastening connection for an elevator guide rail, comprising a vertical docking plate, wherein fixing side plates are welded on two sides of the vertical docking plate symmetrically, fixing holes are provided on a side of the fixing side plates, upright plugging plates are welded at two ends of the vertical docking plate symmetrically, the upright plugging plates are docked with first buckling blocks on a side, the upright plugging plates are docked with second buckling blocks on a side away from the first buckling blocks, the fixing side plates are welded with lateral arc-shaped plates horizontally on a side away from the vertical docking plate, a turnover strut is provided between the lateral arc-shaped plates horizontally, a middle fixing rod is plugged within a top face of each of the lateral arc-shaped plates, the top face of each of the lateral arc-shaped plates is provided with limiting holes uniformly, an adjusting nut block is snapped on a side of the turnover strut, the turnover strut is plugged horizontally with an extension rod on a side away from the lateral arc-shaped plates, the extension rod is provided with an open slot on a side away from the turnover strut, a turnover insertion rod is plugged on an inner side of the open slot, the turnover insertion rod is welded with a fixing plate at an end away from the open slot, connecting holes are provided on a side of the fixing plate uniformly, a main rail rod is docked at the two ends of the vertical docking plate, lateral fixing plates are welded symmetrically on two sides of the main rail rod, connecting through-holes are provided on a side of each of the lateral fixing plates uniformly, hidden grooves are provided at an end of the main rail rod symmetrically, a lateral horizontal rod is welded on a side of the vertical docking plate horizontally, the extension rod is plugged with a plugging rod at an end away from the turnover strut, an upright limiting rod is plugged on an end of the turnover strut, an insertion hole is provided on a side of each of the upright plugging plates uniformly, a socketing pipe is plugged on an inner side of the insertion hole horizontally, a plugging snap rod is plugged on the inner side of the insertion hole horizontally, the main rail rod is provided with a mating insertion slot at an end adjacent to the vertical docking plate, extension slot holes are provided on an inner side of the mating insertion slot, the turnover strut is provided with an inner socketing slot at an end away from the lateral arc-shaped plates, a transverse limiting slot is provided symmetrically on an inner side of the inner socketing slot, a bottom socketing slot is provided on a bottom face of the inner side of the inner socketing slot horizontally, a turnover snap plate is snapped on an inner side of the bottom socketing slot, a plugging turnover rod is plugged on a side of the turnover snap plate, a reset spring is socketed on an outer side of two ends of the plugging turnover rod fixedly, lateral snapping blocks are welded on two sides of the extension rod symmetrically, a bottom sleeve slot is provided on a bottom face of the extension rod horizontally, a rack rod is welded on an inner side of the bottom sleeve slot horizontally, a first extension rod is welded at an end of the plugging turnover rod horizontally, and a limiting ring is welded on an outer side of the extension rod fixedly.

2. The structural member of guided fastening connection for the elevator guide rail according to claim 1, wherein a number of the fixing side plates is two, the two fixing side plates are respectively provided at a position adjacent to the side of the vertical docking plate symmetrically and fixedly, a side of each of the two fixing side plates remains at a same horizontal position as the side of the vertical docking plate, the fixing holes are provided at a position adjacent to a corner of the side of the fixing side plate respectively, a number of the upright plugging plates is two, and the two upright plugging plates are respectively provided at a position on a vertical central line of the vertical docking plate symmetrically and fixedly.

3. The structural member of guided fastening connection for the elevator guide rail according to claim 1, wherein the first buckling blocks and the second buckling blocks are provided consistently in size and respectively snapped at a position on an inner side of the hidden groove correspondingly, a number of the lateral arc-shaped plates is four, the four lateral arc-shaped plates are superposed on the side of the fixing side plate adjacent to a central position two by two in parallel, and a side of each of the four lateral arc-shaped plates is welded at a position on two ends of the lateral horizontal rod vertically and fixedly.

4. The structural member of guided fastening connection for the elevator guide rail according to claim 1, wherein a number of the turnover strut is two, an end of each of the two turnover struts is plugged at a position between a same group of lateral arc-shaped plates horizontally, the middle fixing rod is plugged through a position at the end of each of the two turnover struts vertically, there are a plurality of limiting holes, the plurality of limiting holes are arranged at positions on the top face of each of the lateral arc-shaped plates adjacent to an arc-shaped side at equal intervals in a shape of an arc, and the adjusting nut block comprises a first end provided with a hexagonal hole and a second end welded at a position on an end of the first extension rod horizontally.

5. The structural member of guided fastening connection for the elevator guide rail according to claim 1, wherein an end of the extension rod is plugged at a position on the inner side of the inner socketing slot horizontally, the turnover insertion rod comprises an end extending through the open slot to an outer side and an extension end welded onto a central position of the side of the fixing plate vertically, the connecting holes are provided at a position on the side of the fixing plate adjacent to four corners, the lateral fixing plates are provided in consistent with the fixing side plates, and ends of the lateral fixing plates are docked at positions at two ends of the fixing side plate.

6. The structural member of guided fastening connection for the elevator guide rail according to claim 1, wherein the hidden grooves are respectively provided at positions at two ends of each of the extension slot holes symmetrically, an interior of the hidden groove remains communicated with an interior of each of the extension slot holes, the lateral horizontal rod is fixedly provided at a central position of the side of the vertical docking plate horizontally, two ends of the lateral horizontal rod are welded at positions on sides of the lateral arc-shaped plates horizontally, a bottom end of the plugging rod extends through a top face of the extension rod to the inner side of the open slot, and a plugging end of the plugging rod passes through and is plugged at a position on an inner side of an end of the turnover insertion rod.

7. The structural member of guided fastening connection for the elevator guide rail according to claim 1, wherein two ends of the upright limiting rod are both plugged at a position on an inner side of a corresponding one of the limiting holes symmetrically and fixedly, an end of the socketing pipe is welded at a position at an end of each of the second buckling blocks horizontally, a first end of the plugging snap rod is welded at a position at an end of each of the first buckling blocks horizontally, a second end of the plugging snap rod is plugged on an inner side of the socketing pipe, a snap ring is provided on an outer side of the plugging snap rod, a snap slot is provided on the inner side of the socketing pipe uniformly, the mating insertion slots are respectively socketed at a position on an outer side of each of the upright plugging plates symmetrically, and the extension slot holes are respectively communicated with two ends of the insertion hole correspondingly.

8. The structural member of guided fastening connection for the elevator guide rail according to claim 1, wherein the bottom socketing slot is provided at a position adjacent to an open end of the inner socketing slot horizontally, an interior of the bottom socketing slot remains communicated with an interior of the inner socketing slot, a side of the turnover snap plate is plugged at a position between bottom racks of the rack rod in an inclined manner, the two ends of the plugging turnover rod are plugged at a position on the inner side of the bottom socketing slot, and the lateral snapping blocks are respectively snapped at a position on an inner side of the transverse limiting slot correspondingly.

9. The structural member of guided fastening connection for the elevator guide rail according to claim 1, wherein the bottom sleeve slot is provided at a position on a central line of the bottom face of the extension rod horizontally, the first extension rod is provided at a position at the end of the plugging turnover rod adjacent to the adjusting nut block horizontally and fixedly, and an end of the first extension rod is welded at a central position of an end of the adjusting nut block horizontally.

* * * * *